US007722366B2

(12) United States Patent
Yamamoto et al.

(10) Patent No.: US 7,722,366 B2
(45) Date of Patent: May 25, 2010

(54) BOARD-MOUNTED ELECTRICAL CONNECTOR

(75) Inventors: Masahiro Yamamoto, Yokohama (JP); Tetsuo Hoshino, Yokohama (JP); Yoshihiro Tetsuka, Nikkou (JP)

(73) Assignee: Molex Incorporated, Lisle, IL (US)

( * ) Notice: Subject to any disclaimer, the term of this patent is extended or adjusted under 35 U.S.C. 154(b) by 335 days.

(21) Appl. No.: 10/575,137

(22) PCT Filed: Oct. 25, 2004

(86) PCT No.: PCT/US2004/035214

§ 371 (c)(1),
(2), (4) Date: Sep. 29, 2008

(87) PCT Pub. No.: WO2005/043693

PCT Pub. Date: May 12, 2005

(65) Prior Publication Data

US 2009/0035964 A1 Feb. 5, 2009

(30) Foreign Application Priority Data

Oct. 29, 2003 (JP) ..... 2003-368515

(51) Int. Cl.
*H01R 12/00* (2006.01)

(52) U.S. Cl. ..... 439/79

(58) Field of Classification Search ..... 439/79, 439/80

See application file for complete search history.

(56) References Cited

U.S. PATENT DOCUMENTS

| | | | | |
|---|---|---|---|---|
| 4,955,819 | A * | 9/1990 | Harting et al. | 439/79 |
| 5,090,912 | A * | 2/1992 | Zell | 439/79 |
| 5,252,080 | A * | 10/1993 | Pesson | 439/79 |
| 5,453,016 | A | 9/1995 | Clark et al. | |
| 6,183,270 | B1 * | 2/2001 | Huang et al. | 439/79 |
| 6,540,551 | B1 | 4/2003 | Wang | |
| 2003/0166349 | A1 * | 9/2003 | Huss et al. | 439/79 |

FOREIGN PATENT DOCUMENTS

| | | |
|---|---|---|
| EP | 1 073 165 A1 | 1/2001 |
| EP | 1 341 270 A1 | 9/2003 |

OTHER PUBLICATIONS

International Search Report for PCT/US2004/035214.

* cited by examiner

*Primary Examiner*—Briggitte R Hammond
(74) *Attorney, Agent, or Firm*—Larry I. Golden

(57) ABSTRACT

An electrical connector is provided for mounting on a circuit board and includes a dielectric housing mounting a plurality of first terminals having circuit board press-fit portions projecting therefrom. A plurality of second terminals are mounted on the housing and have circuit board press-fit portions projecting therefrom. A press-fitting block is engageable with the housing and is locked to the first terminals for press-fitting the first terminals into holes in the circuit board. The press-fit portions of the second terminals are exposed exteriorly of the housing and the press-fitting block for locking engagement by an appropriate independent pressfitting jig for press-fitting the second terminals into holes in the circuit board.

9 Claims, 18 Drawing Sheets

FIG. 1
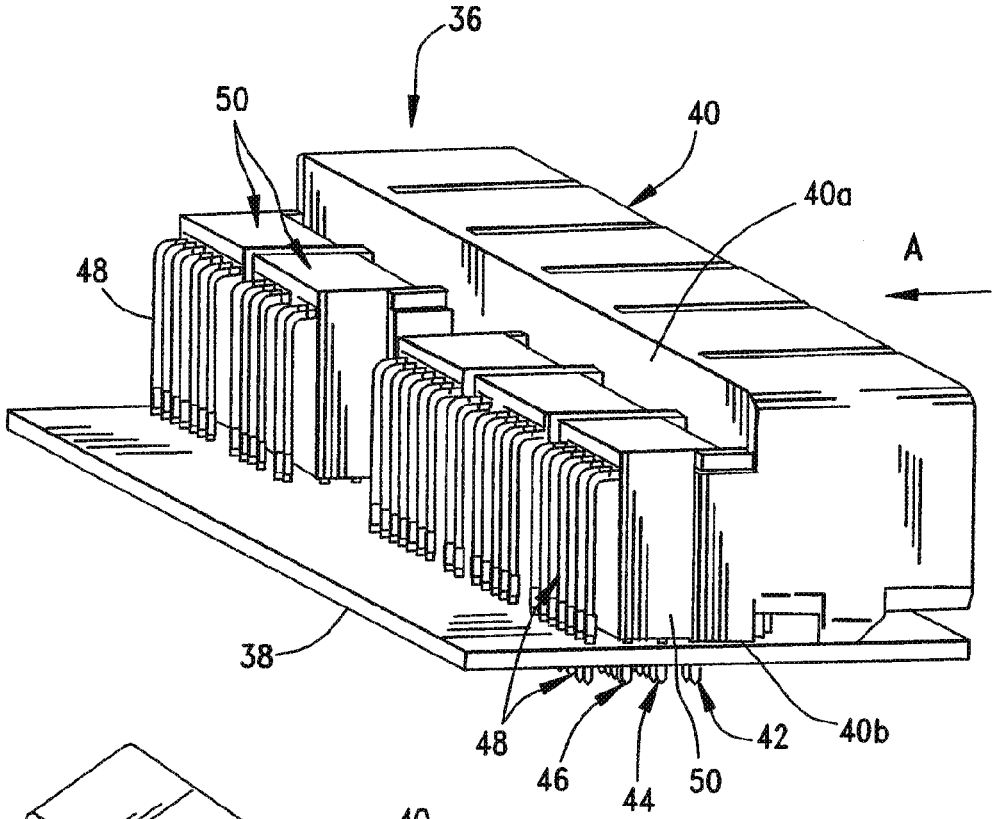
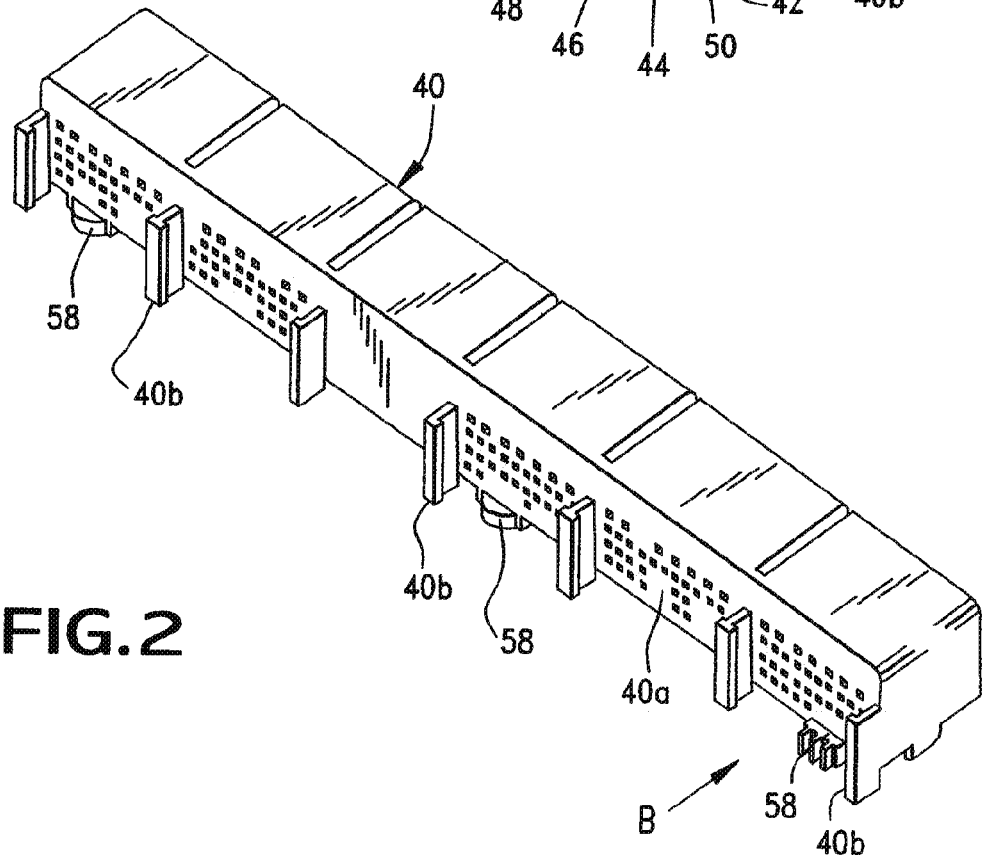
FIG. 2

BOARD-MOUNTED ELECTRICAL CONNECTOR

FIELD OF THE INVENTION

This invention generally relates to the art of electrical connectors and, particularly, to an electrical connector for mounting on a circuit board.

BACKGROUND OF THE INVENTION

Generally, an electrical connector includes some form of dielectric housing which often is molded of plastic material. A plurality of conductive metal terminals are mounted in the housing. In many applications, the connector is designed or adapted for mounting on a printed circuit board, and the terminals have tail portions for connection, as by soldering, to appropriate circuit traces on the board. For instance, the tail portions may be inserted into through holes in the circuit board, with the tail portions connected to circuit traces on the board and/or in the holes.

One application for such board mounted connectors is in the automotive industry for computer control of various functions of the automobile by connecting a multi-function electrical cable to a circuit board. For example, a computer control device for an automobile is contained in a control box and is placed under seat, behind a dashboard, in the engine compartment, etc. Due to the number of system functions, a connector for connecting the multi-function cable to the circuit board has undergone an increase in the number of terminals of the connector, along with hybridization of the types of terminals as well as various different terminal sizes.

Conventionally, a connector of this type generally includes a plurality of rows of terminals arranged in parallel, with the terminals being soldered to the circuit traces on the board. However, with different sizes and types of terminals, the soldering device and soldering process has become quite complicated, resulting in an increase in labor and costs.

Consequently, it has been proposed to press-fit the terminals of the connector into through holes in the circuit board, rather than using solder connections. An example is shown in FIGS. 31-35 and as disclosed in JP 09-501435 A, Official Gazette of Japanese Utility Model Registration No. 2113212, and JP 3244440 B.

Specifically, a connector, generally designated 10, is adapted for mounting on a circuit board, generally designated 12, having through holes 12*a* and circuit traces 12*b* extending into the holes. The connector includes a dielectric housing 14 mounting a plurality of L-shaped terminals, generally designated 16. The terminals have downwardly-directed tails 16*a* with press-fit portions 16*b* at the distal ends thereof, along with locking portions 16*c* immediately upwardly of the press-fit portions. The press-fit portions 16*b* of tails 16*a* of terminals 16 are inserted through holes 12*a* of circuit board 12 in the direction of arrow "A" (FIG. 31). The terminals are arranged in four horizontal rows as well as a plurality of vertical columns as seen in FIG. 33. FIG. 32 shows four terminals in a single column.

A press-fitting block, generally designated 18, is used to insert the terminals into the holes in the circuit board. The block includes a plurality of slots 18*a* which are aligned with the plurality of columns of terminals. A plurality of windows 18*b* communicate with the slots. As best seen in FIG. 33, a plurality of locking grooves 18*c* are formed at the bottom of the press-fitting block generally at the entrances to slots 18*a*.

The locking grooves are sized for receiving locking portions 16*c* of the terminals in a locking, abutting engagement therewith.

In order to electrically mount connector 10 on circuit board 12, the connector is positioned as shown in FIGS. 32 and 33 with the extreme distal ends of tails 16*a* of the terminals inserted holes 12*a* in the circuit board. It can be seen that press-fit portions 16*b* of the terminals have enlarged compliant configurations so that the press-fit portions cannot be inserted into the holes without pressure. Press-fitting block 18 then is positioned as shown in FIG. 32 and is pushed downwardly in the direction of arrow "B". Locking portions 16*c* of the terminals lockingly engage within locking grooves 18*c* of the block, whereupon the block presses the press-fit portions 16*b* of the terminals into holes 12*a* in the circuit board as seen in FIG. 34. The enlarged compliant press-fit portions 16*b* of the terminals are compressed and establish a tight electrical connection with the circuit traces in the through holes in the circuit board.

The above-described prior art apparatus or system works adequately when the terminals are arranged in parallel at the same pitch, and the terminals are generally of the same configurations. However, if the terminals are at different pitches (spacings) the use of a single press-fitting block 18 becomes quite complicated.

For instance, FIG. 35 shows connector 10 in conjunction with press-fitting block 18 and wherein first terminals 16A are in one row and second terminals 16B are in a second row offset from the first row. It can be seen that the locking portions 16*c* of the terminals also are offset. In order to use a single press-fitting block 18, slots 18A and 18B also must be offset from each other which requires locking grooves 18*c* also to be offset. Unfortunately, the locking grooves interfere with each other or become parts of each other and cannot fulfill their intended purposes. This problem is magnified by increasing the number of terminals which decreases the pitch or spacing between the terminals, as well as in connectors where different pitches for different rows of terminals are encountered, along with different configurations of terminals. The present invention is directed to solving this myriad of problems.

SUMMARY OF THE INVENTION

An object, therefore, of the invention is to provide a new and improved electrical connector of the character described, for mounting on a circuit board.

In the exemplary embodiment of the invention, the connector includes a dielectric housing mounting a plurality of first terminals having circuit board press-fit portions projecting therefrom. A plurality of second terminals are mounted on the housing and have circuit board press-fit portions projecting therefrom. A press-fitting block is engageable with the housing and is locked to the press-fit portions of the first terminals for press-fitting the first terminals into holes in the circuit board. The press-fit portions of the second terminals are exposed exteriorly of the housing and the press-fitting block for locking engagement by an appropriate independent press-fitting jig for press-fitting the second terminals into holes in the circuit board.

According to one aspect of the invention, the press-fitting block has an abutment surface arranged for engagement by an abutment surface on the press-fitting jig. Therefore, the jig is effective to press fit the first terminals into the circuit board, through the press-fitting block, as the jig is press-fitting the second terminals into the board.

According to another aspect of the invention, the first and second terminals have lock portions engageable by the press-fitting block and the press-fitting jig, respectively. The lock portions are adjacent to the press-fit portions of the respective terminals.

As disclosed herein, the first terminals are signal terminals and the second terminals are power source terminals. The first and second terminals may be arranged in parallel at different pitches. The first and second terminals may be arranged in generally parallel rows. The first terminals may be offset from the second terminals in a direction generally parallel to the rows. In the exemplary embodiment, the first and second terminals are L-shaped, with mounting legs mounted in the housing and generally right-angled legs including the press-fit portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of an electrical connector according to the invention, mounted on a circuit board;

FIG. 2 is a perspective view of the dielectric housing of the connector;

DETAILED DESCRIPTION OF THE PREFERRED EMBODIMENT

Figure 3:
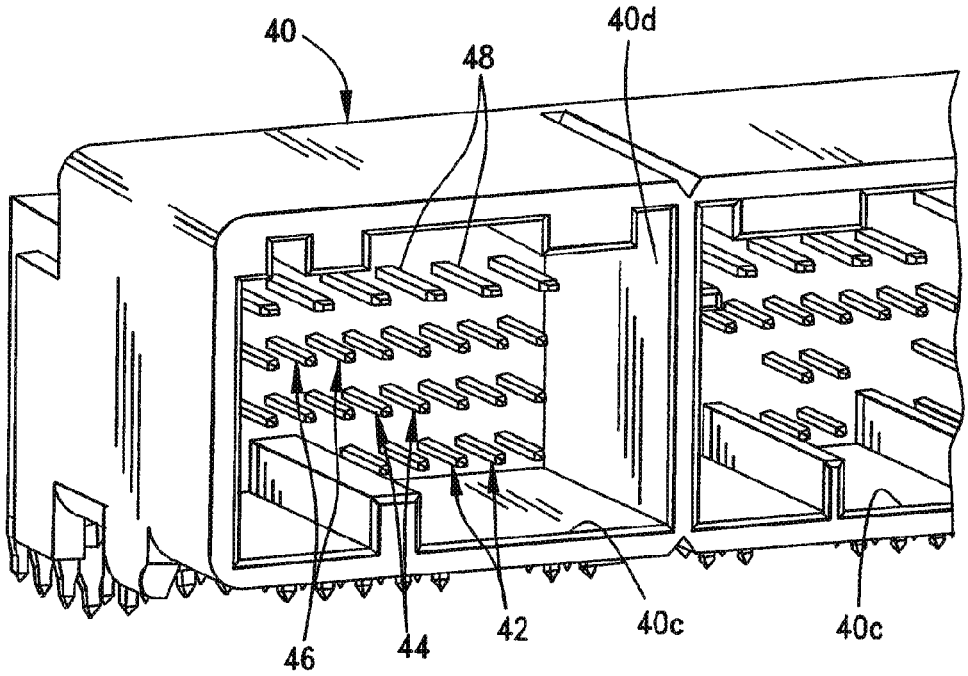
FIG. 3 is a fragmented perspective view taken in the direction of arrow "A" in FIG. 1.

Referring to the drawings in greater detail, and first to FIG. 1, the invention is embodied in an electrical connector, generally designated 36, which is designed or adapted for mounting on a circuit board 38. The connector includes a dielectric housing, generally designated 40, having a mounting face 40*a* into which three rows of signal terminals, generally designated 42, 44 and 46, are mounted, along with one row of power source terminals, generally designated 48. The signal terminals are arranged in a first pitch along the rows, and the power source terminals are arranged in a second pitch along the single row thereof. As will be understood hereinafter, a plurality of press-fitting blocks, generally designated 50, are used to press-fit signal terminals 42-46 into circuit board 38.

Referring to FIG. 2 in conjunction with FIG. 1, housing 40 includes a plurality of vertical columns 40*b* projecting-rearwardly from mounting face 40*a* of the housing. The housing may be molded of dielectric plastic material, and the columns may be molded integrally therewith.

FIG. 3 shows that housing 40 has one or more receptacles 40*c* for receiving one or more complementarily mating connectors (not shown). In the illustrated embodiment, a plurality of receptacles 40*c* are provided for receiving a plurality of mating connectors, with the receptacles divided by interior walls or partitions 40*d* of the housing.

Figure 4:
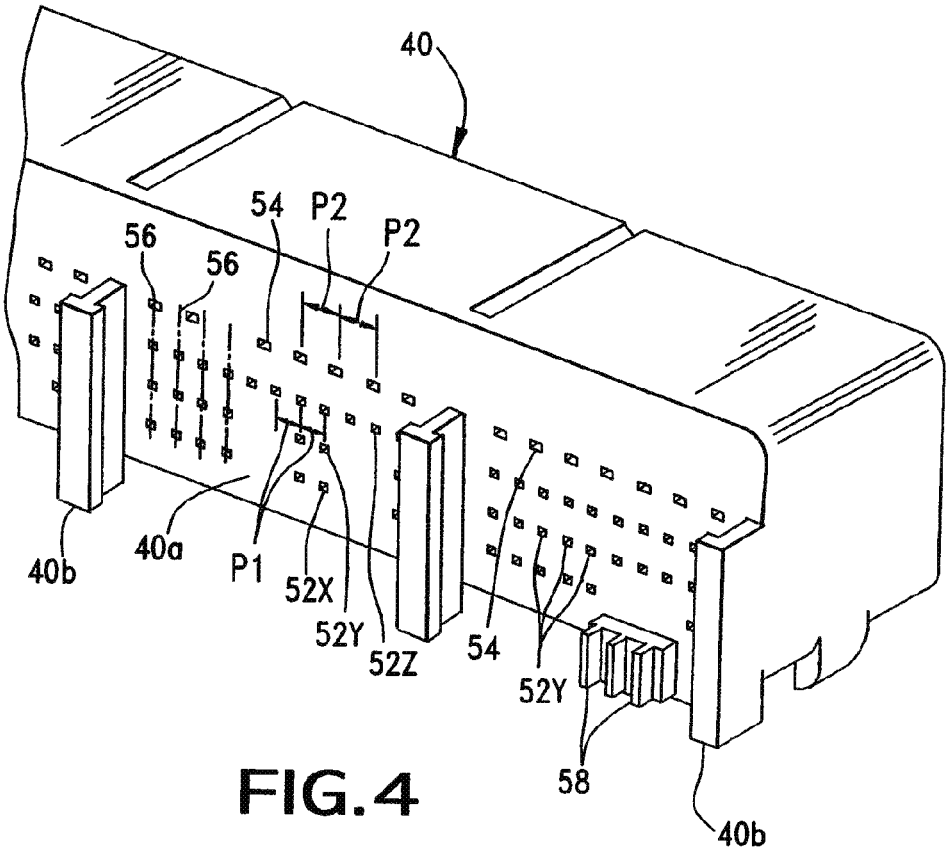
FIG. 4 is a fragmented, enlarged perspective view looking the direction of arrow "B" in FIG. 2.

FIG. 4 shows a plurality of terminal-receiving passages through mounting face 40*a* of housing 40. There are three rows of passages 52X, 52Y and 52Z for receiving signal terminals 42, 44 and 46, respectively. There is one row of passages 54 for power source terminals 48. The passages for the signal terminals are arranged in columns 56 which do not necessarily line up with or intersect passages 54 for the power source terminals. Specifically, the passages for the signal terminals in each row thereof are on a first, smaller pitch or spacing □P1", and the passages in the row thereof for the power source terminals are at a larger pitch or spacing □P2". The end result is that the passages for the signal terminals often are offset from the passages for the power source terminals. FIG. 4 also shows a support platform 58 which may be positioned at various points along housing 40 (see FIG. 2) for supporting the press-fitting blocks 50.

Figure 5:
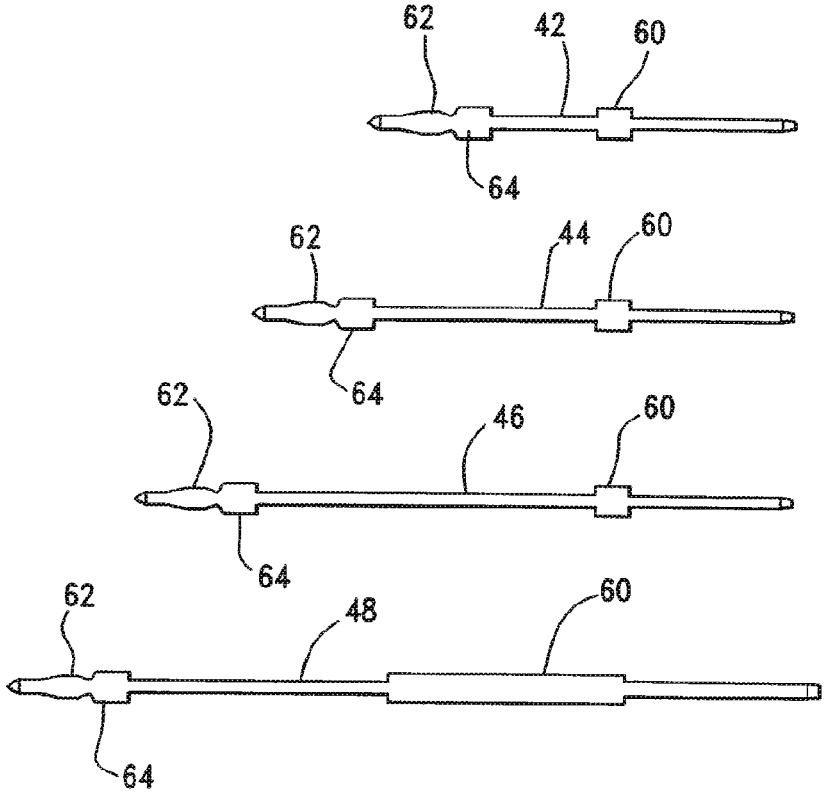
FIG. 5 is a plan view of four terminals in one column in the connector of the invention, before the terminals are formed in right-angles.

Referring to FIG. 5, all of the signal and power source terminals are stamped and formed of conductive sheet metal material. The terminals are shown in FIG. 5 in their stamped condition for insertion into housing 40, before the terminals are bent into their final right-angled configurations for insertion into circuit board 38. Specifically, all of the signal and power source terminals 42-48 have enlarged mounting sections 60 for fixing the terminals in the housing. The distal ends of all of the terminals have enlarged press-fit portions 62. All of the terminals have lock portions 64 immediately adjacent the press-fit portions, for purposes described hereinafter. It can be seen that signal terminals 42 are shorter than signal terminals 44 which, in turn, are shorter than signal terminals 46 which, in turn, are shorter than power source terminals 48. This allows the terminals to be bent at right angles and nested in vertical relationships as will be seen hereinafter. Also as will be seen hereinafter, press-fit portions 62 of the terminals are slightly larger than their through holes in circuit board 38, and lock portions 64 are larger than the respective through holes to limit the insertion of the terminals into the holes.

Figure 6:
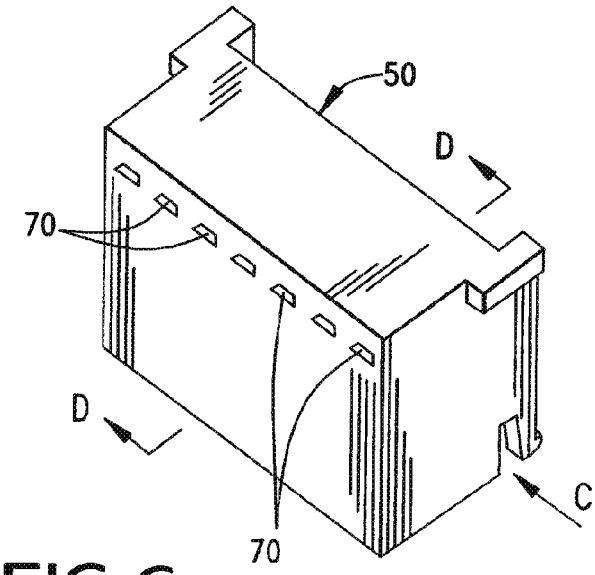
FIG. 6 is a perspective view of one of the press-fitting blocks.
Figure 7:
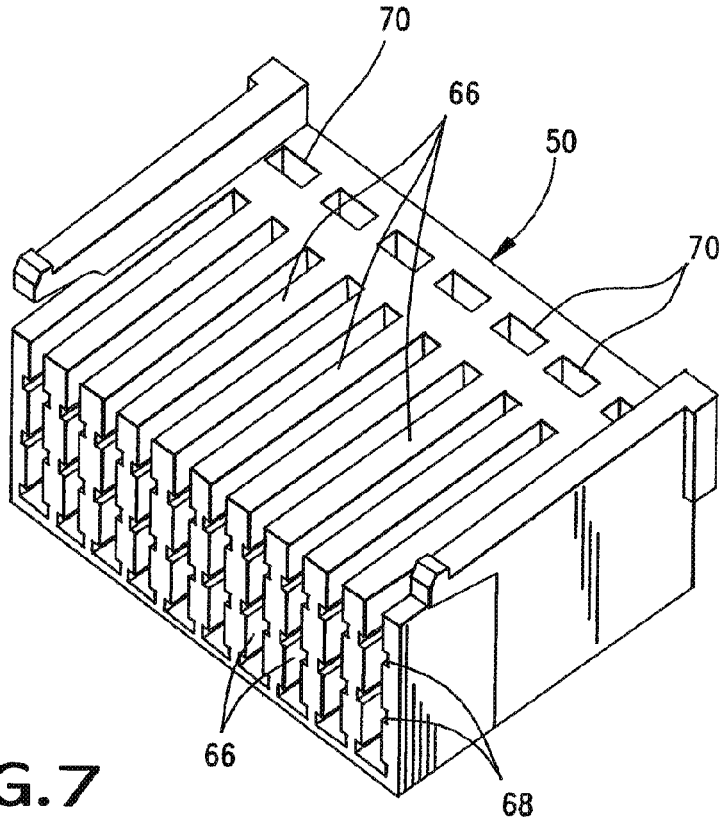
FIG. 7 is a perspective view looking in the direction of arrow "C" in FIG. 6.
Figure 8:
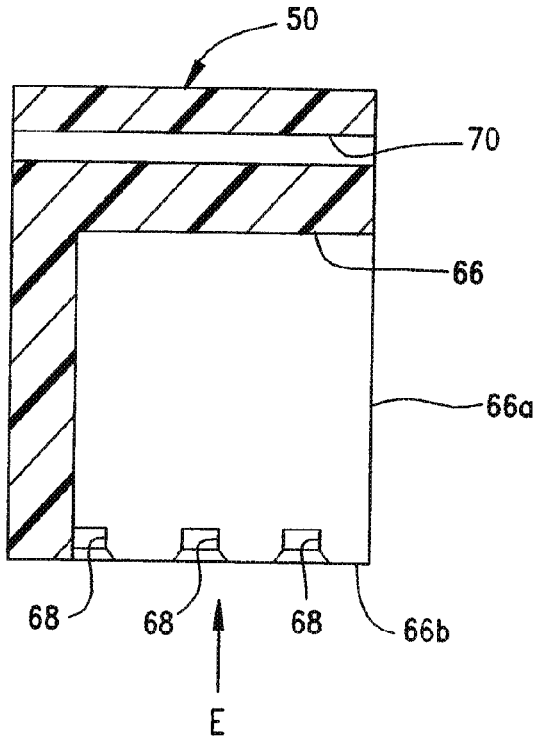
FIG. 8 is a vertical section taken generally along line D-D in FIG. 6.

FIGS. 6-8 show one of the press-fitting blocks 50 shown in and described above in relation to FIG. 1. Each press-fitting block is wide enough to receive the nested signal terminals 42-46 in their L-shaped configurations as described hereinafter. FIG. 1 shows five blocks along the length of housing 40 of connector 36. The blocks may be molded of dielectric plastic material.

Each press-fitting block 50 includes a plurality of slots 66 which are open at the inside thereof, as at 66*a*, and at the bottom thereof, as at 60*b*. Therefore, slots 66 are open toward mounting face 40*a* of the housing and are open toward the circuit board. When the block is slidably mounted to the housing, slots 66 are aligned with columns 56 (see FIG. 4) of passages 52X-52Z for receiving three signal terminals in each slot. Correspondingly, as best seen in FIG. 8, three locking grooves 68 are formed at opposite sides of each slot 66 along bottom opening 66*b* of the slot. A plurality of through passages 70 are formed through the block for receiving the power source terminals, as will be seen hereinafter.

Figure 9:
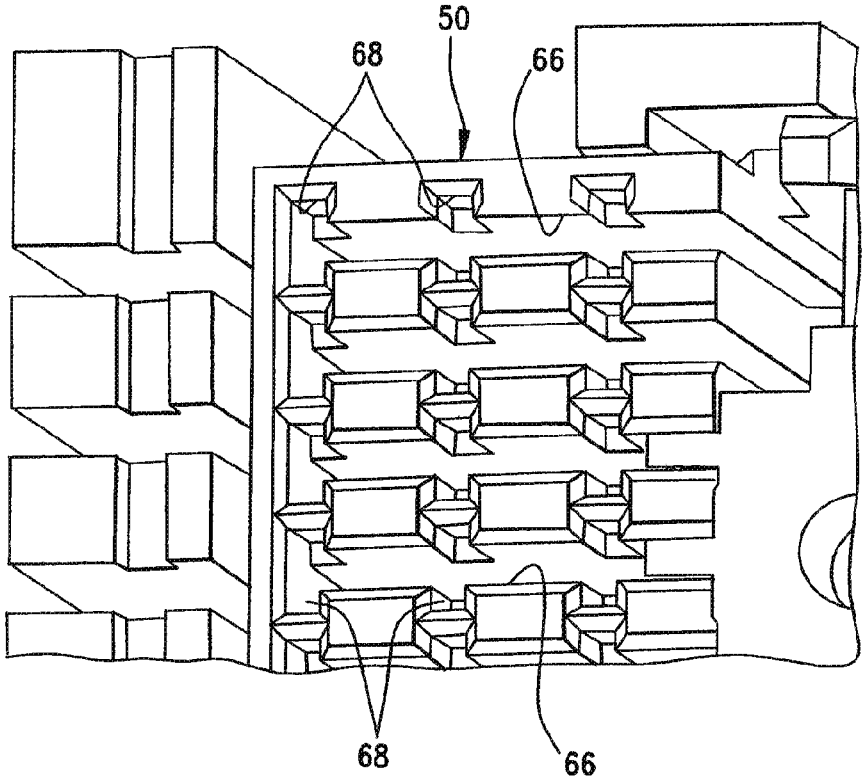
FIG. 9 is an enlarged, fragmented perspective view looking into the slots and locking grooves in one of the press-fitting blocks.
Figure 10:
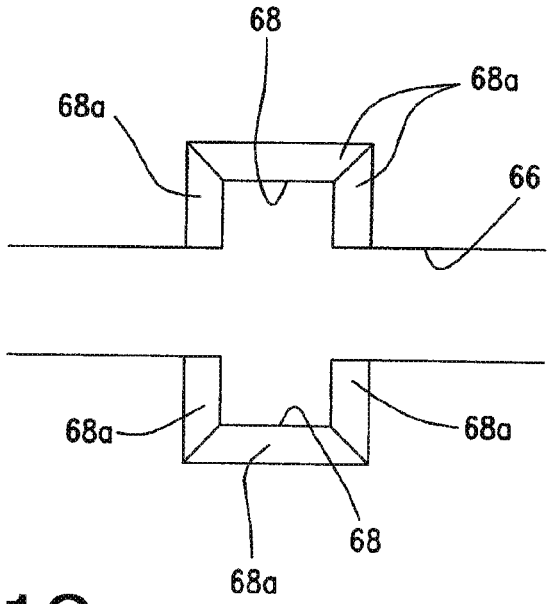
FIG. 10 is a further enlarged depiction of one of the slots and associated locking groove, in the direction of arrow "E" in FIG. 8.
Figure 11:
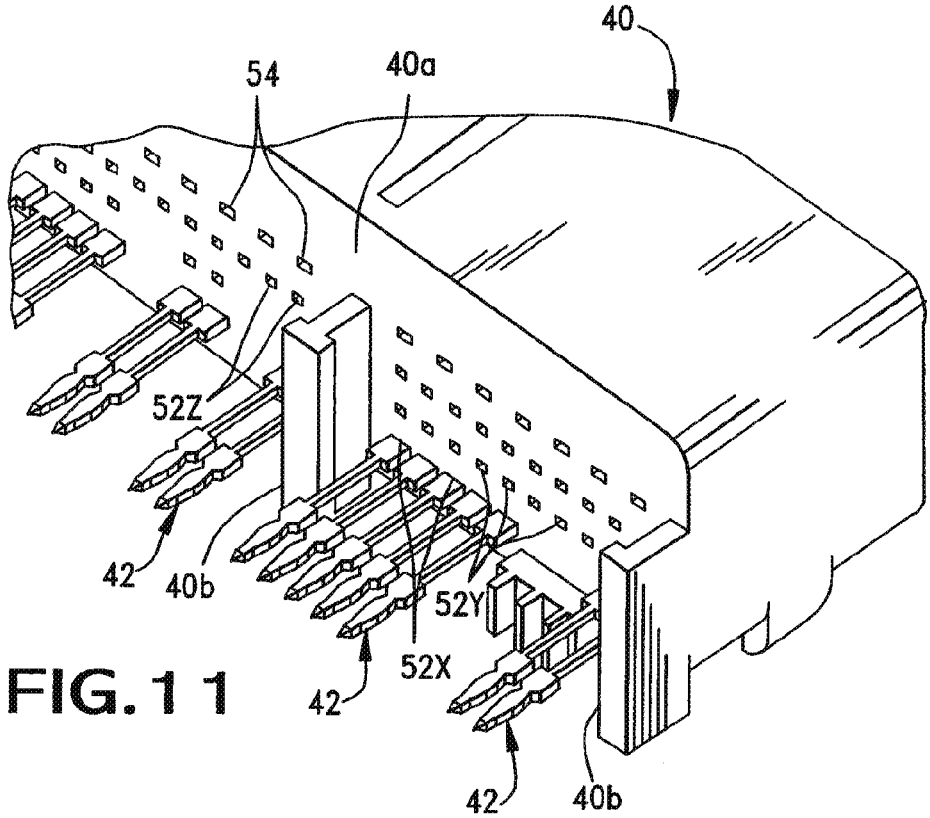
FIG. 11 is a fragmented perspective view showing how one row of the signal terminals are mounted in the housing.

FIGS. 9 and 10 show enlarged depictions of the signal terminal-receiving slots 66 and locking grooves 68 in each press-fitting block 50. It can be seen that the locking grooves are located at opposite sides of the slots. The bottom edges of locking grooves 68 are beveled or chamfered, as seen at 68*a* in FIG. 10.

Figure 12:
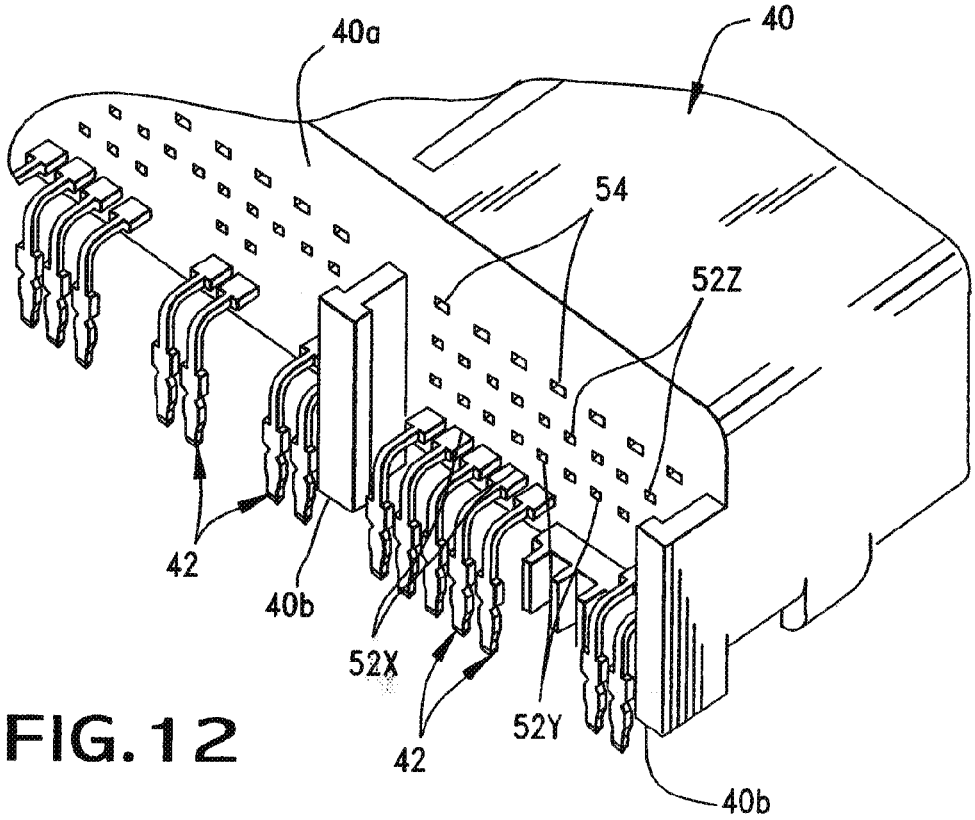
FIG. 12 is a view similar to that of FIG. 11, with the terminals bent to their right-angled configurations.

FIGS. 11-16 show the method of mounting signal terminals 42, 44 and 46 into housing 40. FIG. 7 shows the first row of signal terminals 42 inserted into passages 52X in their linear condition as described above in relation to FIG. 5. Once inserted, the terminals are bent to their right-angled configurations as shown in FIG. 12, in condition for insertion into circuit board 38.

Figure 13:
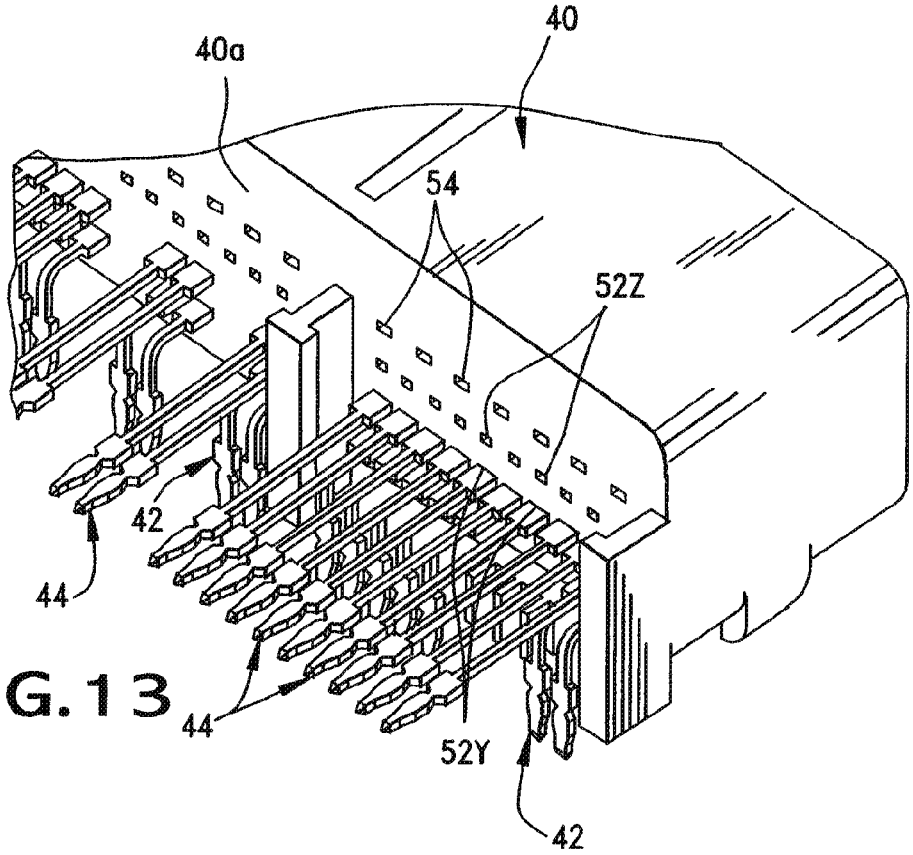
FIGS. 13 and 14 are views similar to that of FIGS. 11 and 12, respectively, but of a second row of signal terminals.
Figure 14:
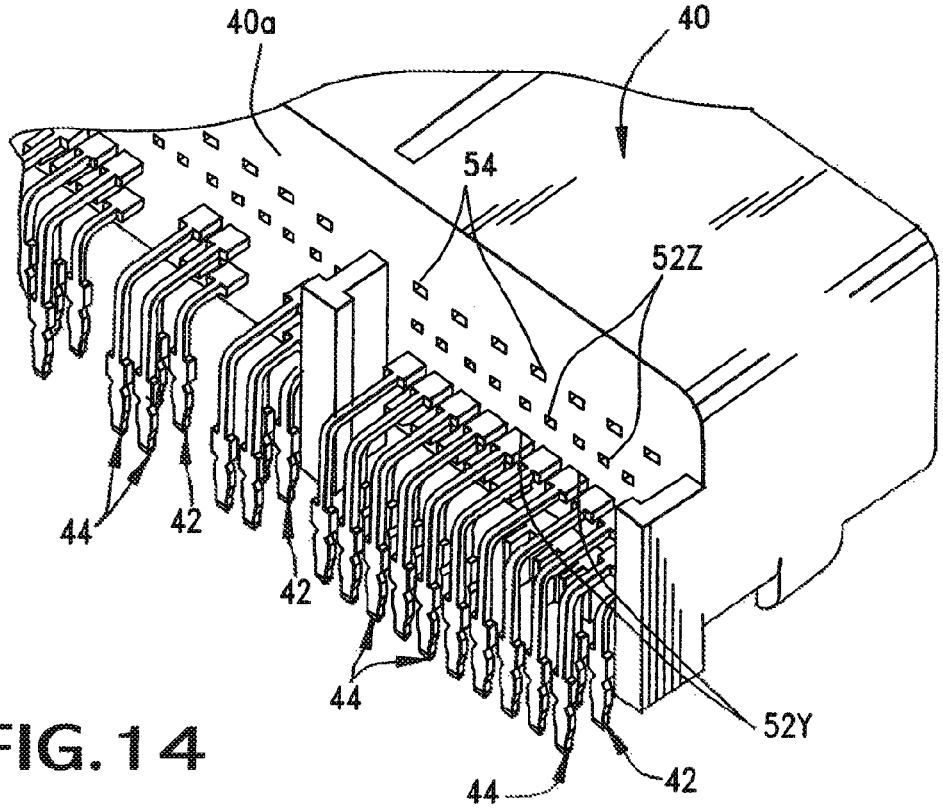

After the first row of signal terminals 42 are inserted into the housing and are bent into their right-angled configurations, the second row of signal terminals 44 are inserted into the housing and are bent as shown in FIGS. 13 and 14. The second row of signal terminals are inserted into passages 52Y.

Figure 15:
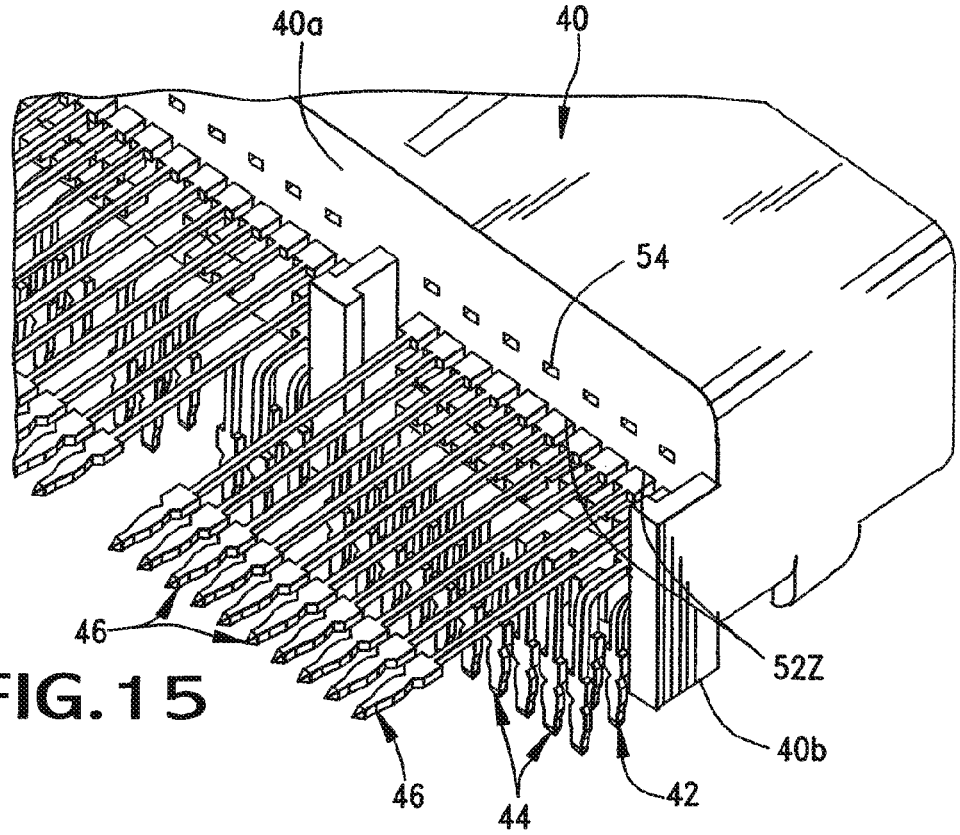
FIGS. 15 and 16 are views similar to that of FIGS. 11 and 12 but showing a third row of signal terminals.
Figure 16:
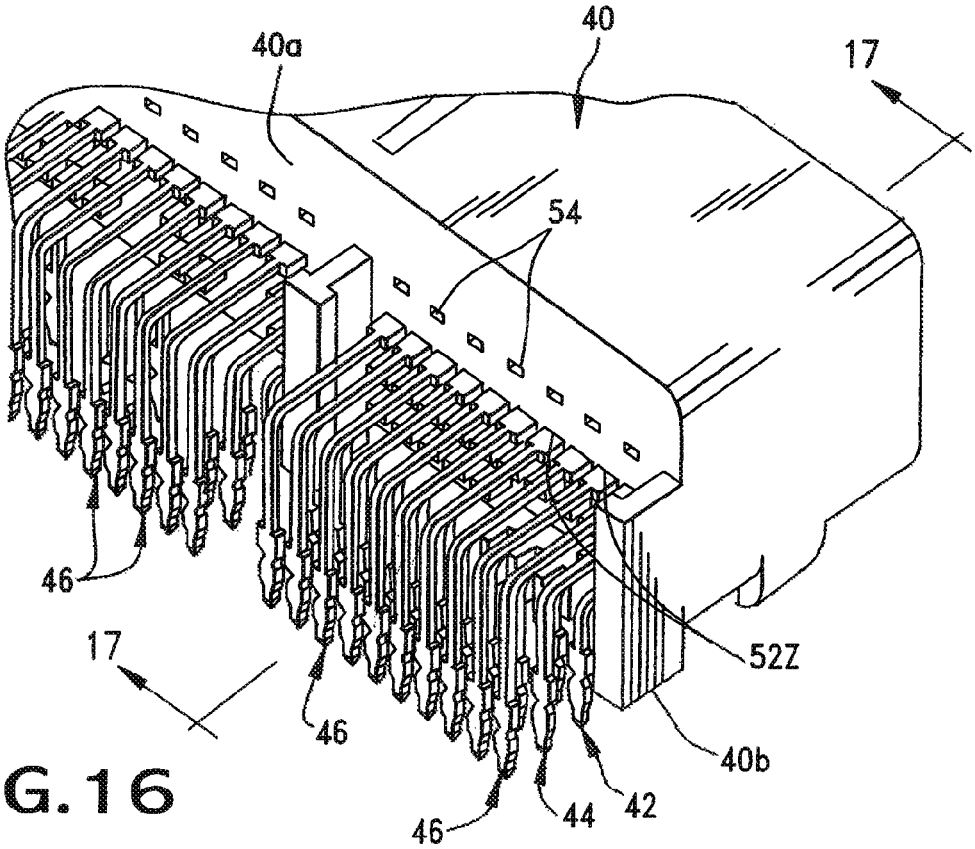

After the second row of signal terminals 44 are inserted into the housing and are bent into their right-angled configurations, the third row of signal terminals 46 are inserted into the housing and are bent as shown in FIGS. 15 and 16. The third row of signal terminals are inserted into passages 52Z.

Figure 17:
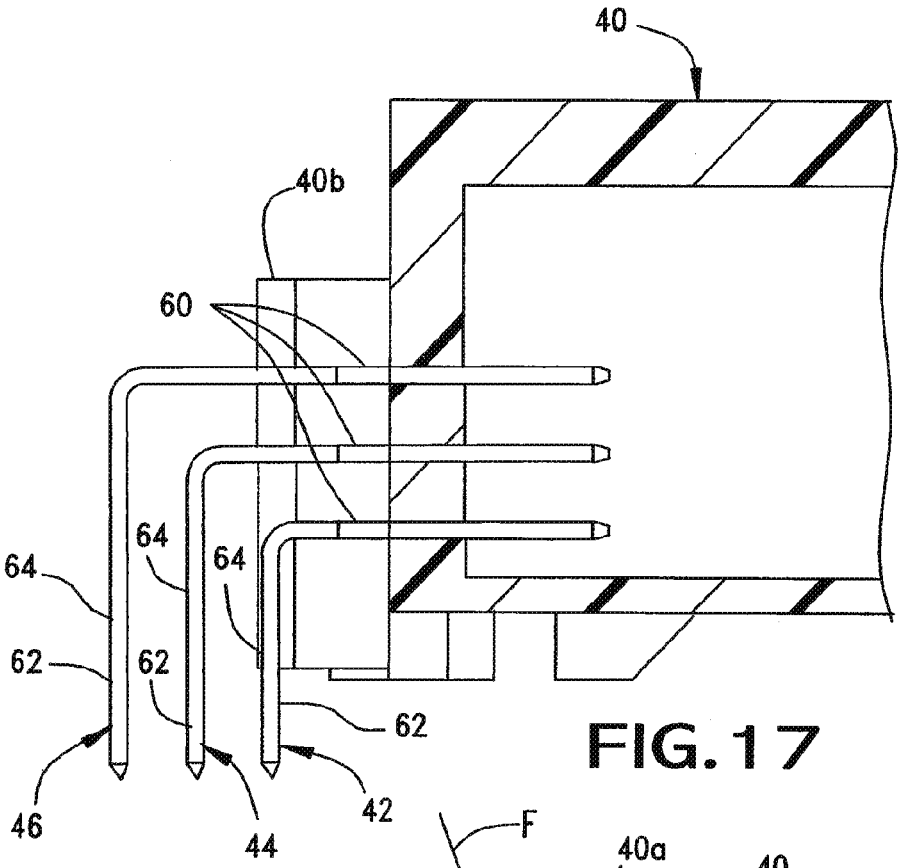
FIG. 17 is a vertical section taken generally along line 17-17 in FIG. 16.

FIG. 17 shows how the three rows of signal terminals 42, 44 and 46 are in a nested, columnar arrangement. This depiction also clearly shows the right-angled configurations of the nested signal terminals.

Figure 18:
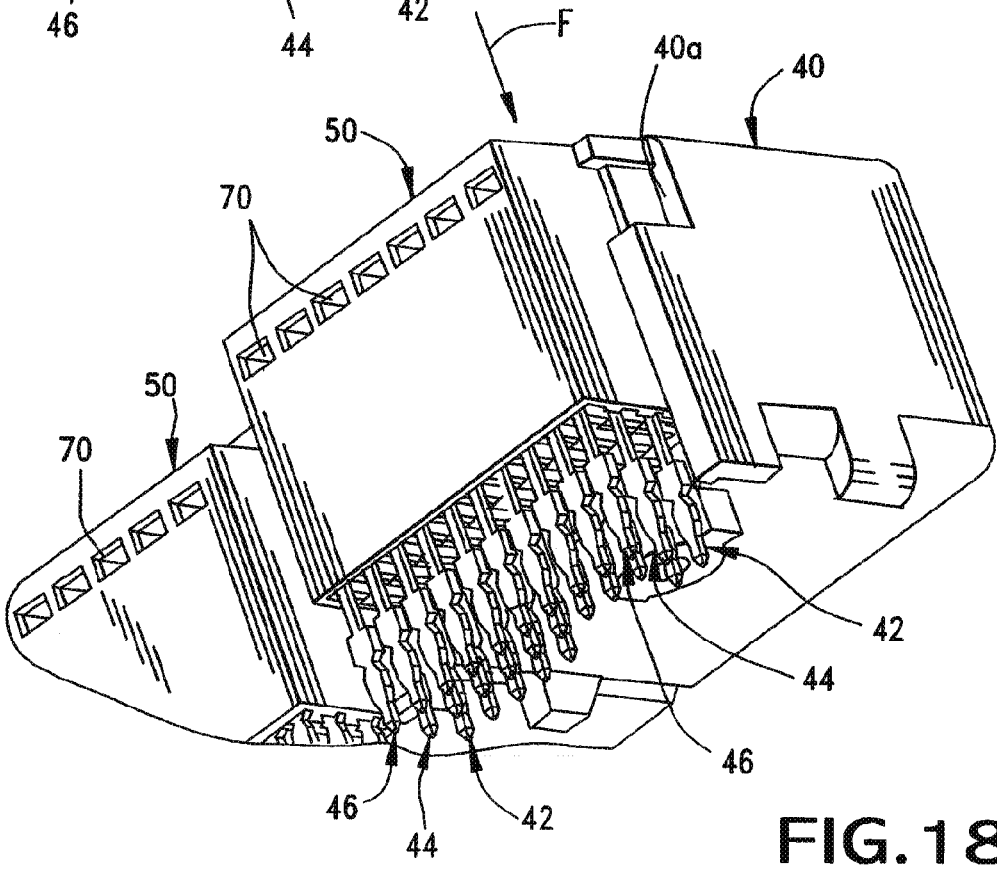
FIG. 18 is a bottom perspective view showing a pair of the press-fitting blocks being mounted in the direction of arrow "F" onto the signal terminals.
Figure 19:
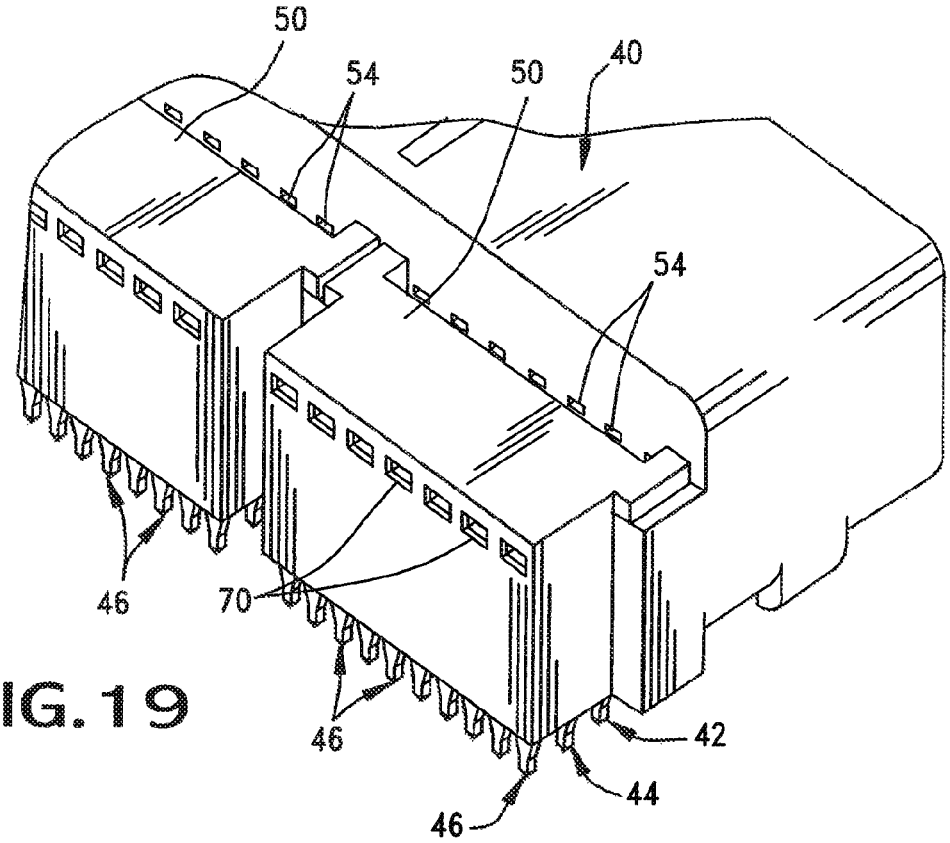
FIG. 19 is a top perspective view similar to FIG. 18.
Figure 20:
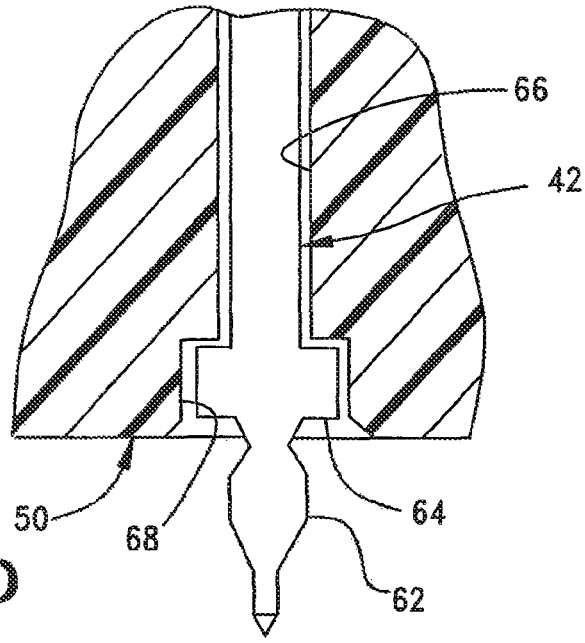
FIG. 20 is an enlarged, fragmented section through one of the slots and locking grooves in one of the press-fitting blocks in conjunction with one of the terminals.

After all of the signal terminals are inserted into housing 40 and are bent into their right-angled configurations, as described above in relation to FIGS. 11-17, the press-fitting blocks 50 are installed over the signal terminals as shown in FIGS. 18 and 19. The blocks are guided by columns 40*b* and are positioned in abutting arrangement against mounting face 40*a* of housing 40 and the blocks are moved downwardly in the direction of arrow □F□ (FIG. 18) to an abutting position on housing 40 as shown in FIG. 19. In this position, FIG. 20 shows how one of the signal terminals 42 is locked in one of the slots 66 in one of the blocks 50. It can be seen that locking portion 64 of the terminal is locked within the locking groove 68 at the bottom of the slot. The press-fit portion 62 of the terminal projects below the block.

Figure 21:
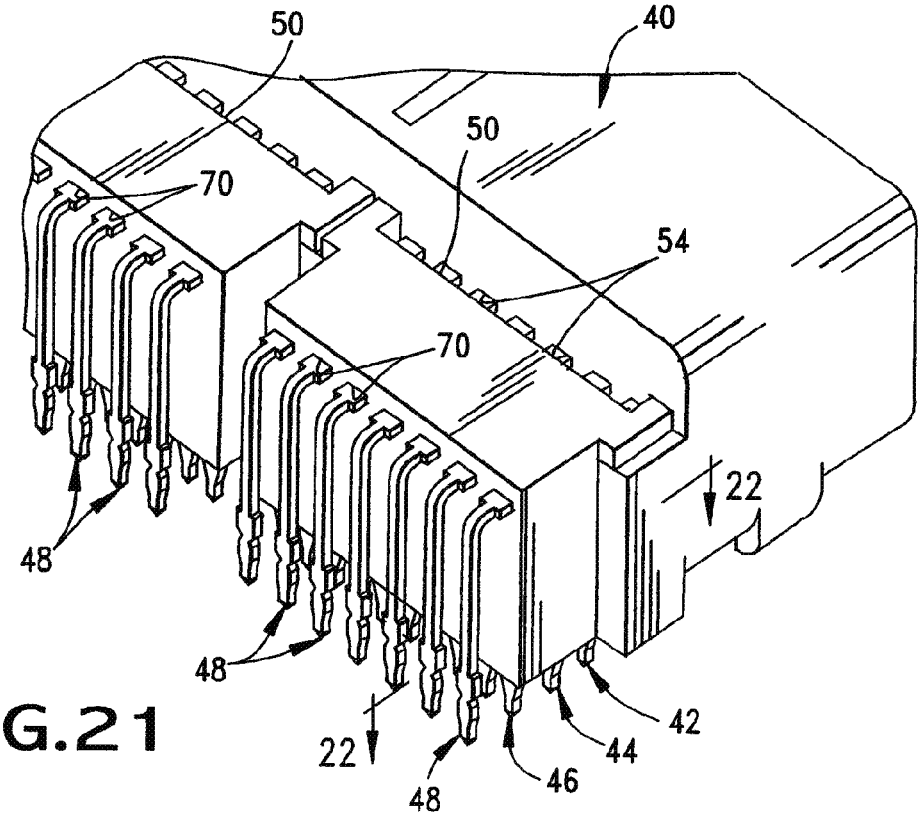
FIG. 21 is a perspective view showing the power terminals added to the connector.

After the press-fitting blocks 50 are installed as described above in relation to FIGS. 18-21, power source terminals 48 are inserted through passages 70 in the blocks and into passages 54 in housing 40. After being inserted in their linear configurations as shown in FIG. 5, the power source terminals are bent into right-angled configurations as shown in FIG. 21.

Figure 22:
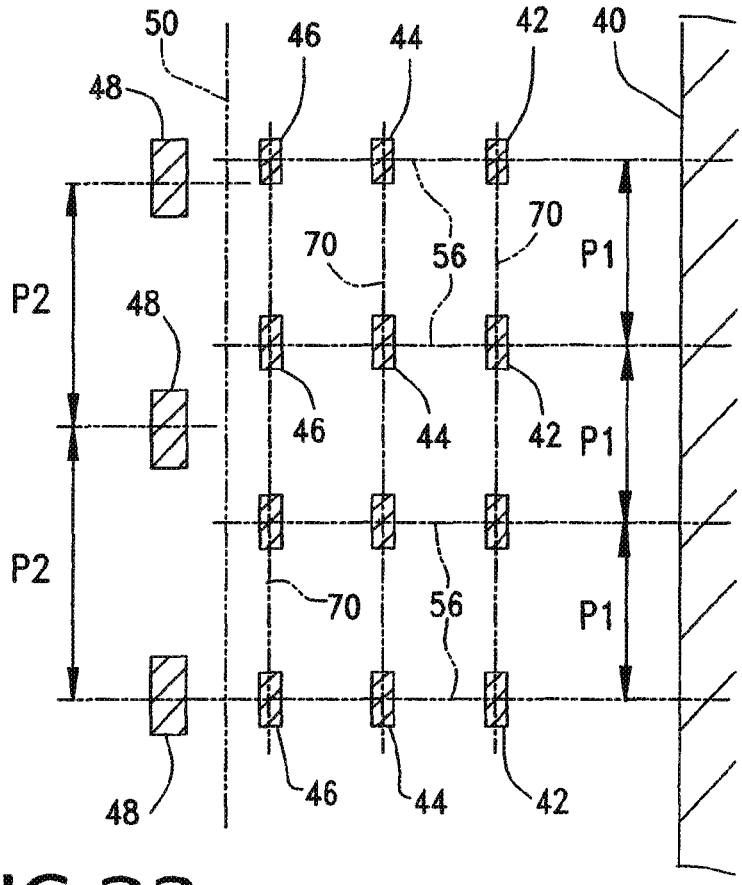
FIG. 22 is a somewhat schematic layout of the signal and power terminals as if taken in the direction of line 22-22 in FIG. 21.

FIG. 22 shows a schematic layout of the signal and power source terminals. As stated, the signal terminals are arranged in three rows 70. The signal terminals also are arranged in columns 56 as described above in relation to FIG. 4. The signal terminals are spaced in each row on pitch "P1".

As described above in relation to FIG. 4, FIG. 22 shows that power source terminals 48 are on a different, larger pitch "P2". Consequently, the power source terminals often are irregularly offset from the signal terminals. Still further, it can be seen that the power source terminals are larger than the signal terminals. All of these variances in the pitch, alignment, size and other differences between the terminals make it extremely difficult if at all possible to mold a press-fitting block which can press all of the terminals into the circuit board.

Figure 23:
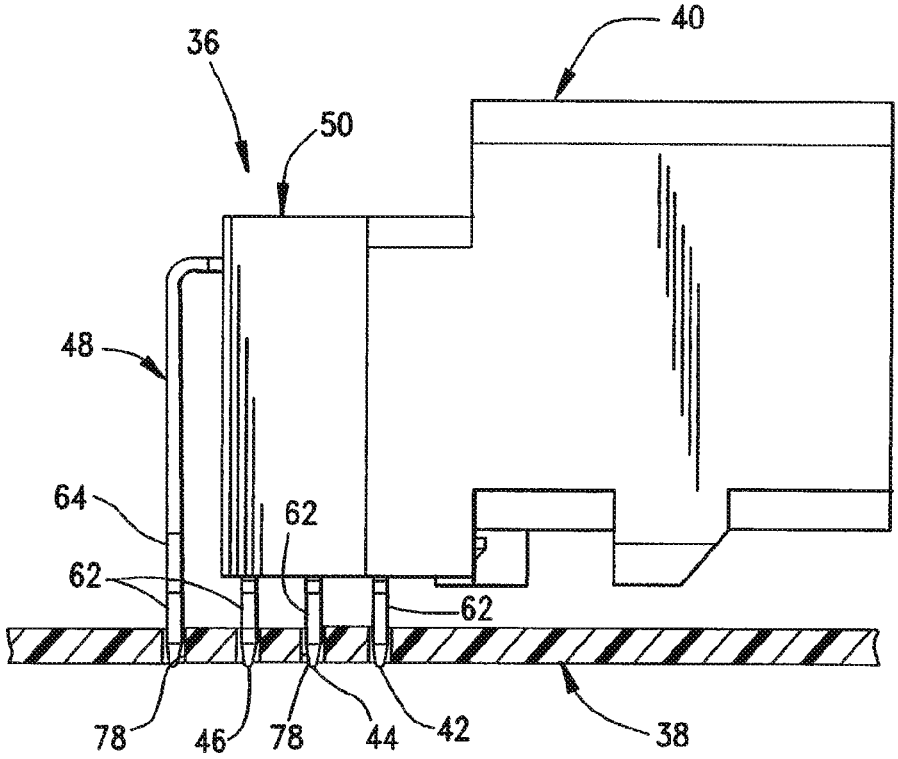
FIG. 23 is a side elevational view as looking at the right-hand side of FIG. 21.

After press-fitting blocks 50 are installed over the signal terminals, and the power source terminals are mounted through the blocks into the housing, this entire connector assembly is preliminarily mounted to circuit board 38 as seen in FIG. 23. Specifically, the tips of the signal and power source terminals are inserted into through holes 78 in the board, but the press-fit portions 62 of the terminals cannot enter the holes and engage the edges of the holes at the top surface of the board.

Figure 24:
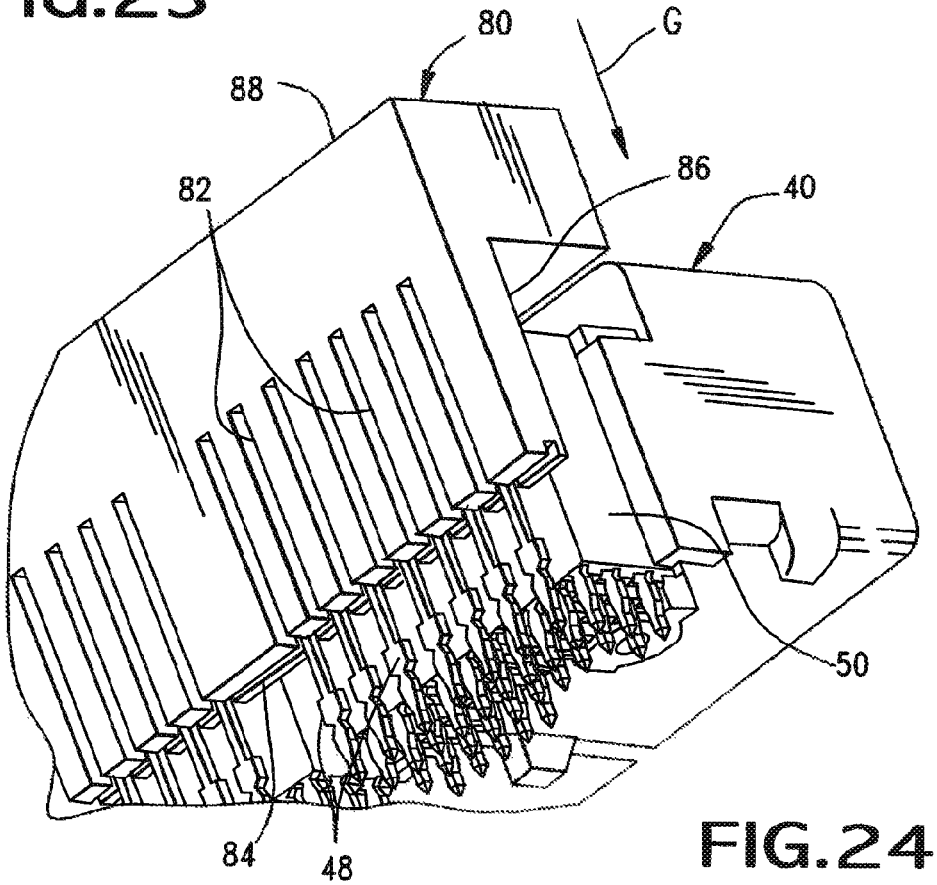
FIG. 24 is a bottom perspective view showing a press-fitting jig being moved in the direction of arrow "G" into engagement with the power terminals.

FIG. 24 shows a press-fitting jig, generally designated 80, which is used not only to press the power source terminals 48 into the printed circuit board, but to force the entire connector, including press-fitting blocks 50 and the signal terminals, into the respective holes in circuit board 38.

Figure 25:
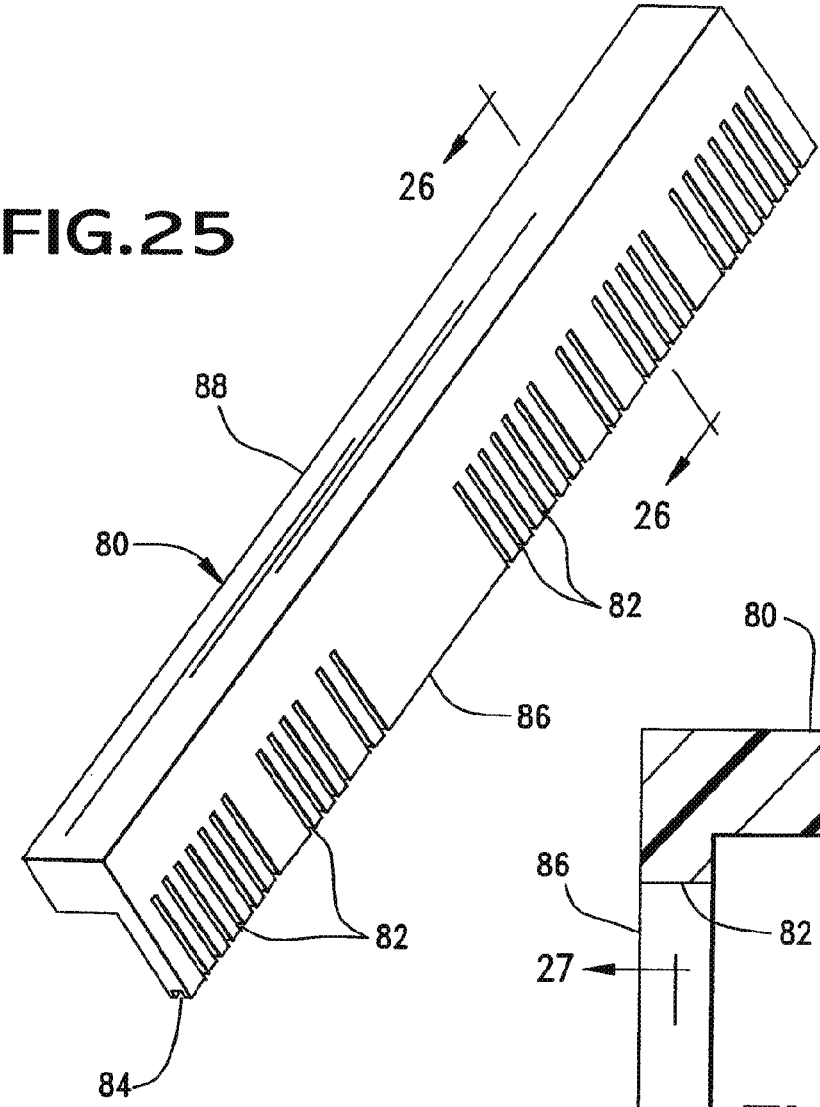
FIG. 25 is a perspective view of the press-fitting jig.
Figure 26:
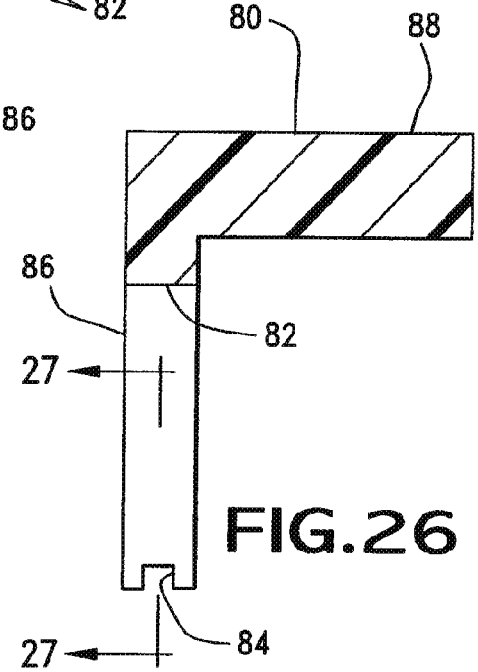
FIG. 26 is an enlarged section taken generally along line 26-26 in FIG. 25.
Figure 27:
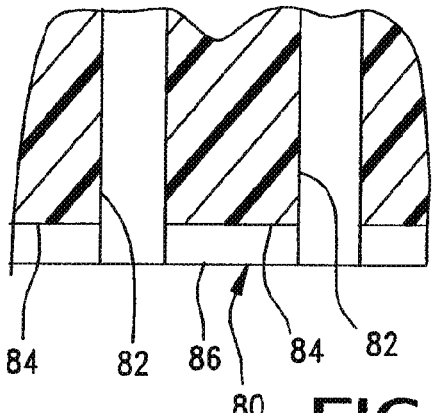
FIG. 27 is a fragmented section taken generally along line 27-27 in FIG. 26.

In particular, referring to FIGS. 25-27 in conjunction with FIG. 24, press-fitting jig 80 is generally L-shaped in crosssection as seen in FIG. 26. The jig includes a plurality of slots 82 for receiving or positioning over the exposed tail portions of the power source terminals. Locking grooves 84 are formed at the bottoms of slots 82. With the L-shaped configuration of the jig, slots 82 are formed in a vertical leg 86 of the jig, and a horizontal leg 88 of the jig extends over the top of the press-fitting blocks 50 as can be seen in FIG. 24. The jig extends the entire length of the connector over all five blocks 50.

Figure 28:
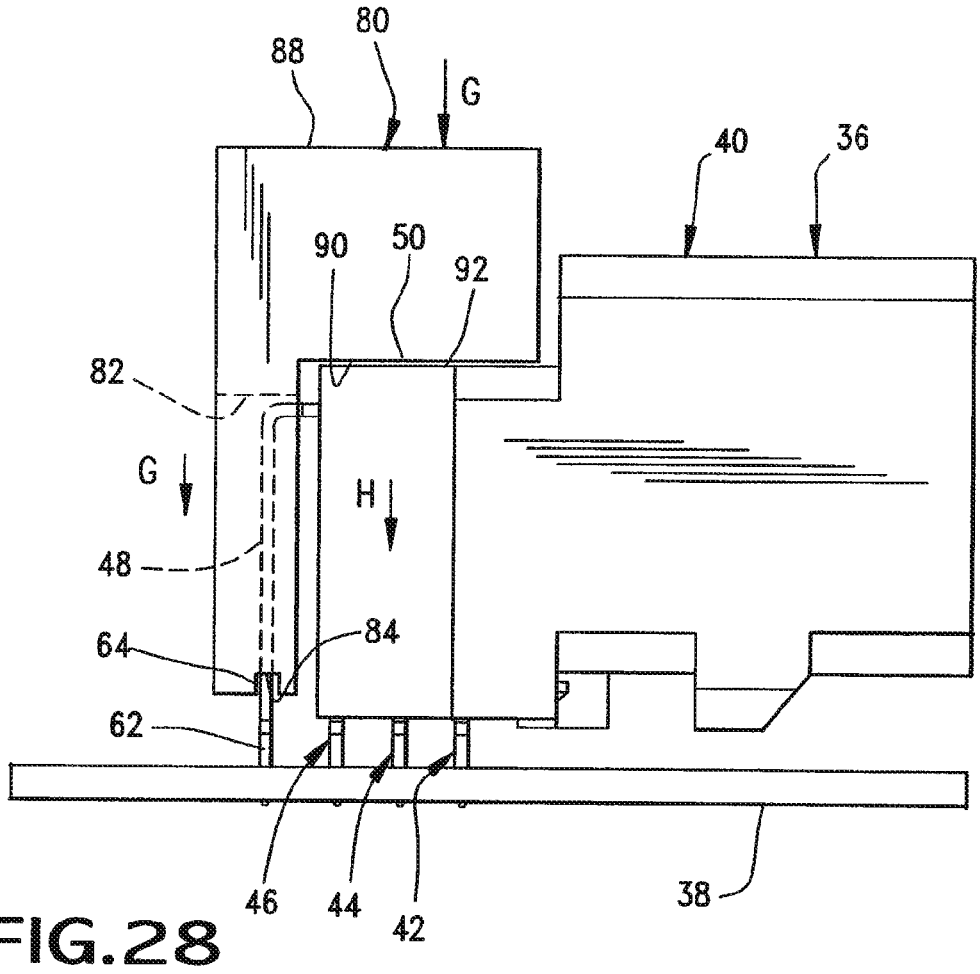
FIG. 28 is a side elevational view looking at the side of FIG. 24, with the press-fitting jig moved into engagement with the press-fitting blocks, in conjunction with a circuit board.
Figure 30:
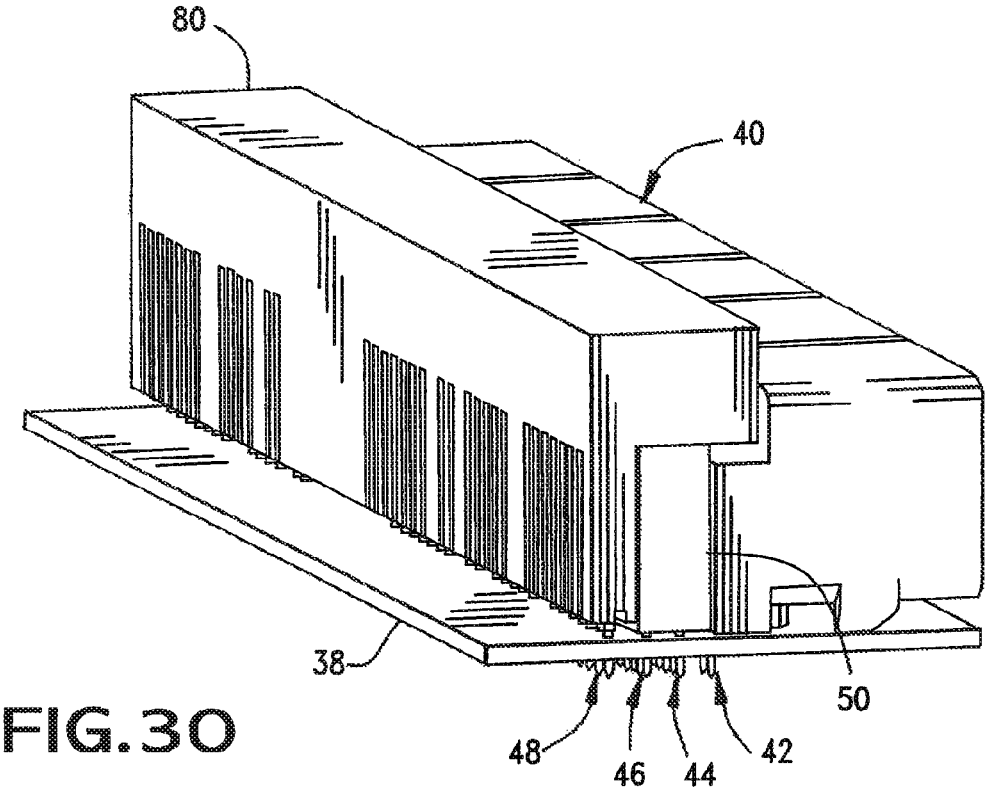
FIG. 30 is a perspective view of the condition of the connector including the press-fitting blocks as well as the press-fitting jig having press-fit all of the terminals into the circuit board.
Figure 32:
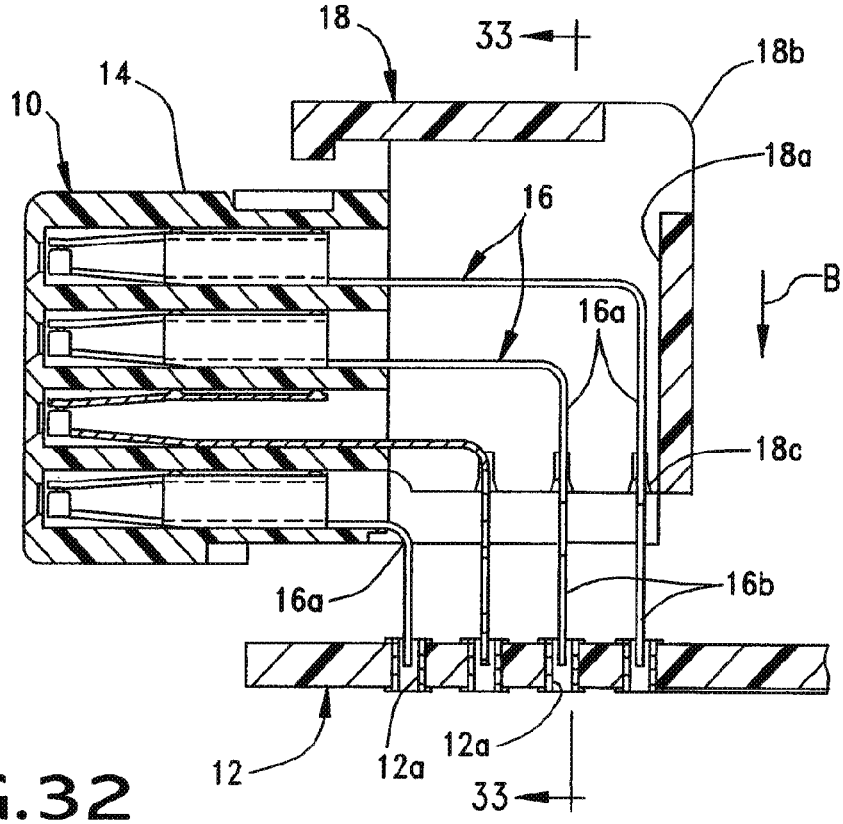
FIG.32 (PRIOR ART)
FIG. 32 is a vertical section through the prior art connector.
Figure 31:
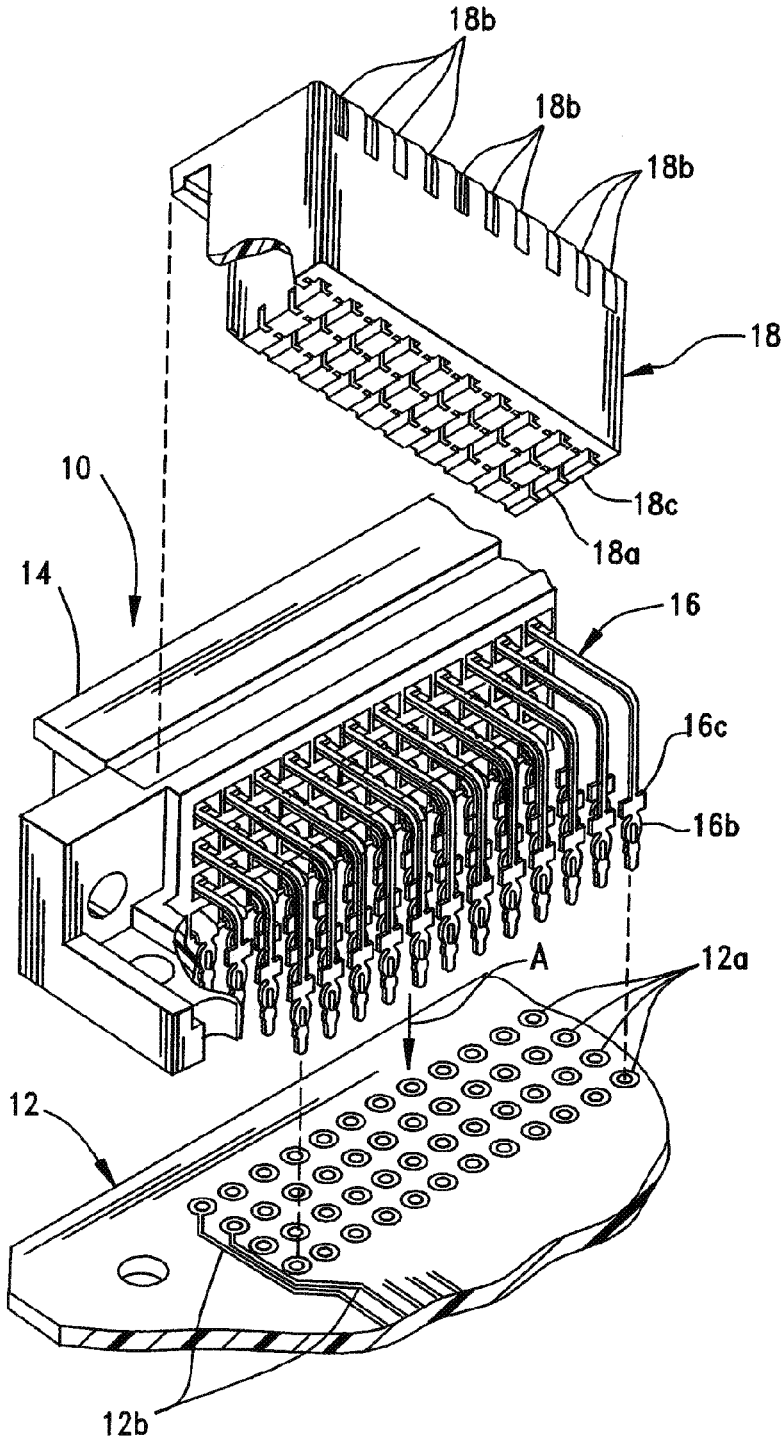
FIG.31 (PRIOR ART)
FIG. 31 is an exploded perspective view of the prior art as described in the Background, above.
Figure 33:
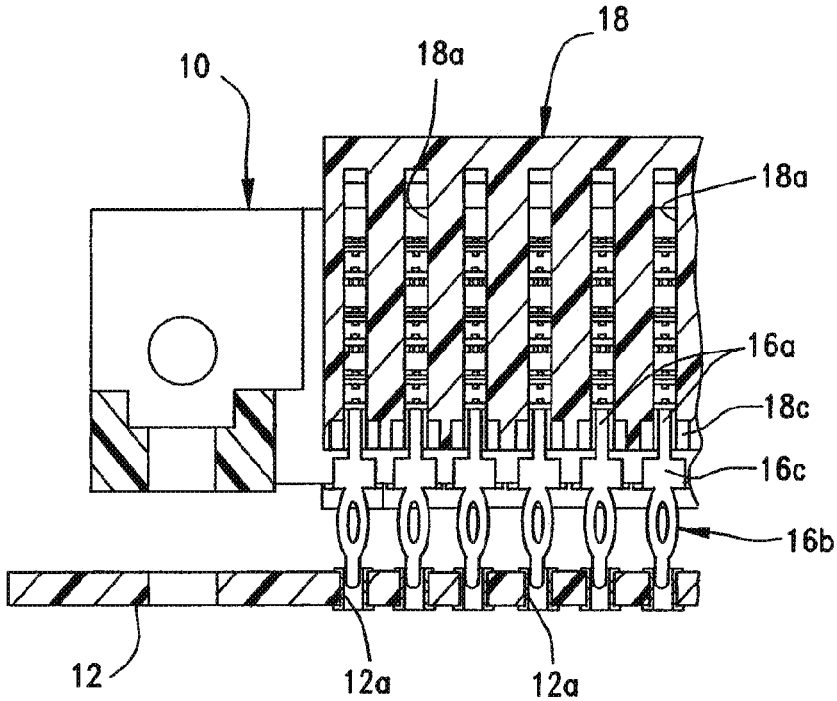
FIG.33 (PRIOR ART)
FIG. 33 is a vertical section taken generally along line 33-33 in FIG. 32.
Figure 34:
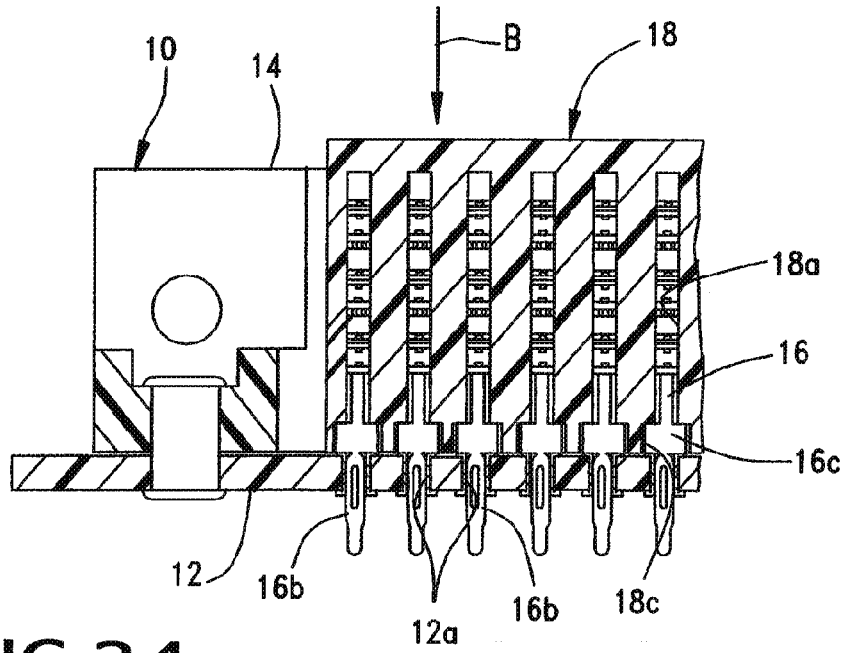
FIG.34 (PRIOR ART)
FIG. 34 is a view similar to that of FIG. 33 and showing the terminals fully inserted the circuit board.
Figure 35:
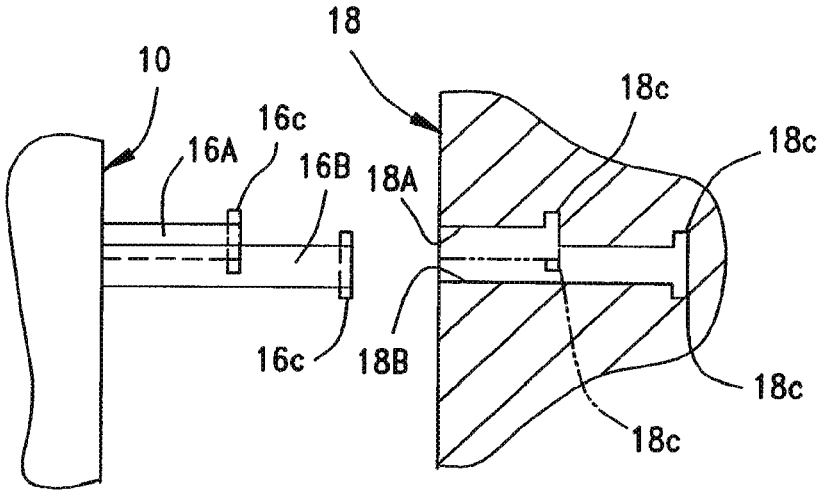
FIG.35 (PRIOR ART)
FIG. 35 is a diagram of the offset slots as described in the Background, above.

FIG. 28 shows press-fitting jig 80 positioned over power source terminals 48 and onto the top of press-fitting blocks 50, with connector 36 in the condition shown in FIG. 23 and described above, preliminarily mounted on circuit board 38. To completely assemble the connector to the board and to press-fit all of the signal terminals 42-46 and the power source terminals 48 into the circuit board, the jig is forced downwardly in the direction of arrows "G" (FIG. 28). This force is transmitted to the press-fitting blocks 50 in the direction of arrow "H" as a bottom surface 90 of the jig engages top surfaces 92 of the blocks. As the jig is forced downwardly, the entire connector, including press-fitting blocks 50, are completely mounted to circuit board 38 as seen in FIG. 30, with all of the signal terminals 42-46 and the power source terminals 48 inserted into their respective through holes in the circuit board.

Figure 29:
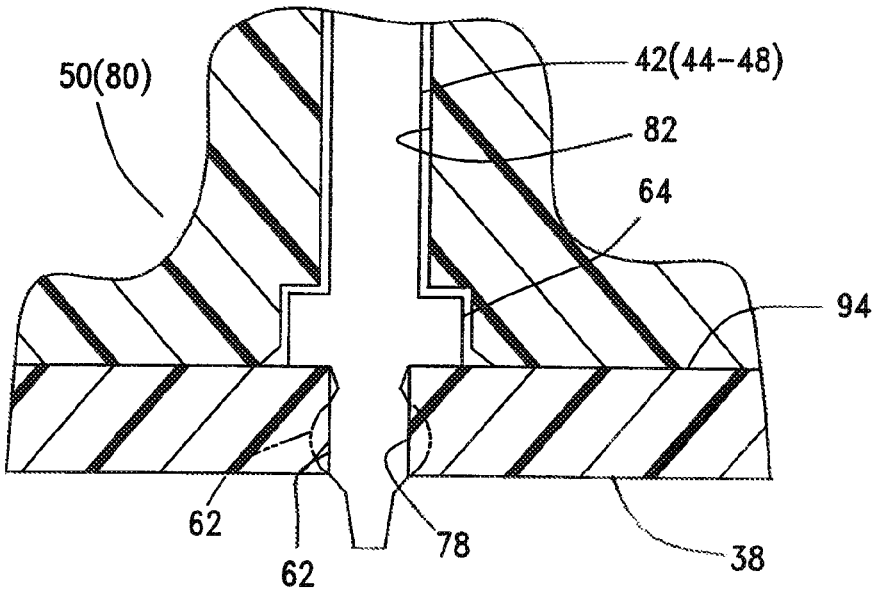
FIG. 29 is an enlarged, fragmented section showing one of the terminals fully inserted into the circuit board.

Finally, FIG. 29 shows one of the terminals which could be any of the signal or power source terminals inserted into a respective through hole 78 in circuit board 38. It can be seen that press-fitting portion 62 has been compressed from its rounded configuration shown in FIG. 5 to a compressed condition shown by full lines in FIG. 29. This rigidly fixes the terminal in the through hole in the board. Locking portion 64 of the terminal abuts against a top surface 94 of the circuit board.

It can be understood that the invention allows the press-fitting blocks 50 and the press-fitting jig 80 to be fabricated in extremely simple configurations. Yet, the signal terminals and the power source terminals can be at different pitches, different sizes and offset from each other. The versatility of the inventive system herein is extremely valuable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a circuit board, comprising:

a dielectric housing;

a plurality of first terminals mounted on the housing and having circuit board press-fit portions projecting from the first terminals;

a plurality of second terminals mounted on the housing and having circuit board press-fit portions projecting from the second terminals;

the first and second terminals being arranged in respective spaced apart rows, said first terminals having a first pitch and said second terminals having a second pitch different from said first pitch;

a press-fitting block engageable with the housing and locked to the first terminals for press-fitting the first terminals into holes in the circuit board; and said press-fit portions of the second terminals being exposed exteriorly of both the housing and the press-fitting block and in locking engagement with an independent press-fitting jig for press-fitting the second terminals into other holes in the circuit board, said press fitting jig engaged with the press fitting block.

2. The electrical connector of claim 1 wherein said first terminals are signal terminals and said second terminals are power source terminals.

3. The electrical connector of claim 1 wherein said first and second terminals are L-shaped with mounting legs mounted in the housing and generally right-angled legs including said press-fit portions.

4. The electrical connector of claim 1 wherein said first and second terminals are arranged in parallel rows.

5. The electrical connector of claim 4 wherein the first terminals are offset from the second terminals in a direction along said respective rows.

6. The electrical connector of claim 1 wherein said press-fitting block has an abutment surface for engagement with the press-fitting jig, whereby the jig is to press fit the first terminals into the circuit board, through the press-fitting block, as the jig is press-fitting the second terminals into the board.

7. In combination with the electrical connector of claim 6, the press-fitting jig having an abutment surface for engaging the abutment surface of the press-fitting block.

8. The electrical connector of claim 1 wherein said first and second terminals have lock portions for engaging with the press-fitting block and the press-fitting jig, respectively.

9. The electrical connector of claim 8 wherein said lock portions are adjacent to the press-fit portions of the respective terminals.

* * * * *